US009250022B2

(12) United States Patent
Oudjedi et al.

(10) Patent No.: US 9,250,022 B2
(45) Date of Patent: Feb. 2, 2016

(54) SPIRAL HEAT EXCHANGER

(71) Applicant: Alfa Laval Corporate AB, Lund (SE)

(72) Inventors: Boualem Oudjedi, Nevers (FR); Pascal Maure, Nevers (FR)

(73) Assignee: ALFA LAVAL CORPORATE AB, Lund (SE)

( * ) Notice: Subject to any disclaimer, the term of this patent is extended or adjusted under 35 U.S.C. 154(b) by 312 days.

(21) Appl. No.: 13/843,752

(22) Filed: Mar. 15, 2013

(65) Prior Publication Data

US 2013/0277023 A1 Oct. 24, 2013

Related U.S. Application Data

(62) Division of application No. 12/746,971, filed as application No. PCT/EP2008/064986 on Nov. 5, 2008, now Pat. No. 8,485,246.

(30) Foreign Application Priority Data

Dec. 11, 2007 (EP) ..... 07122869

(51) Int. Cl.
*F28D 7/10* (2006.01)
*F28D 7/02* (2006.01)
(Continued)

(52) U.S. Cl.
CPC ..... *F28D 9/04* (2013.01); *F28D 7/0066* (2013.01); *F28F 2280/02* (2013.01)

(58) Field of Classification Search
CPC ..... F28D 9/04; F28D 7/0066; F28F 9/262; F28F 9/26; F28F 2280/02
USPC ..... 165/157, 163, 164, 165
See application file for complete search history.

(56) References Cited

U.S. PATENT DOCUMENTS 367,601 A * 8/1887 Dashiell ..... 165/143
714,703 A * 12/1902 Ibert ..... 165/140
1,455,164 A 5/1923 Coen
(Continued)

FOREIGN PATENT DOCUMENTS

EP 0050372 A2 4/1982
EP 0151933 8/1985
(Continued)

OTHER PUBLICATIONS

Office Action issued on May 28, 2013, by the Canadian Patent Office in corresponding Canadian Patent Application No. 2,701,518. (2 Pages).
(Continued)

*Primary Examiner* — Allen Flanigan
*Assistant Examiner* — Jason Thompson
(74) *Attorney, Agent, or Firm* — Buchanan Ingersoll & Rooney PC

(57) ABSTRACT

The invention relates to a spiral heat exchanger including a spiral body formed by at least one spiral sheet wound to form a first spiral-shaped flow channel for a first medium, and a second spiral-shaped flow channel for a second medium. The spiral body is enclosed by a substantially cylindrical shell with connecting elements communicating with the first flow channel and the second flow channel. The shell includes at least two shell parts, and the spiral body is provided with at least one fixedly attached flange on its outer peripheral surface, whereupon the at least two shell parts are removably attached.

20 Claims, 5 Drawing Sheets

(51) Int. Cl.

| | |
|---|---|
| ***F28D 9/04*** | (2006.01) |
| ***F28D 7/00*** | (2006.01) |

(56) References Cited

U.S. PATENT DOCUMENTS

| | | | | | |
|---|---|---|---|---|---|
| 1,791,531 | A | | 2/1931 | Morrow | |
| 1,813,234 | A | * | 7/1931 | Dodd | 165/145 |
| 1,839,133 | A | * | 12/1931 | Uhde | 122/483 |
| 2,060,440 | A | | 11/1936 | Curt | |
| 2,142,679 | A | | 1/1939 | Seifert | |
| 2,242,432 | A | * | 5/1941 | Lukacs | F28D 7/103 165/155 |
| 2,360,739 | A | * | 10/1944 | Strom | F28D 9/04 165/165 |
| 4,089,370 | A | | 5/1978 | Marchal | |
| 4,546,826 | A | | 10/1985 | Zitzmann | |
| 4,577,683 | A | * | 3/1986 | Kelch | 165/164 |
| 5,671,807 | A | | 9/1997 | Lameris | |
| 6,626,235 | B1 | * | 9/2003 | Christie | 165/158 |
| 6,644,391 | B1 | | 11/2003 | Fourt et al. | |
| 2001/0006104 | A1 | | 7/2001 | Okazaki et al. | |
| 2003/0167689 | A1 | * | 9/2003 | Hsu | 48/61 |
| 2008/0073064 | A1 | | 3/2008 | Gueguen | |

FOREIGN PATENT DOCUMENTS

| | | | |
|---|---|---|---|
| EP | 0323377 | | 7/1989 |
| EP | 1214558 | B1 | 10/2004 |
| EP | 1623174 | | 2/2006 |
| FR | 2874080 | A1 | 2/2006 |
| GB | 758030 | A | 9/1956 |
| GB | 1260327 | | 1/1972 |
| GB | 1437460 | A | 5/1976 |
| GB | 2140549 | | 11/1984 |
| GB | 2140549 | A | 11/1984 |
| JP | 62108999 | A | 5/1987 |
| JP | 330083 | U | 3/1991 |
| JP | 4006395 | A | 1/1992 |
| JP | 3044894 | U | 10/1997 |
| JP | 2000310161 | A | 11/2000 |
| SU | 1366843 | | 1/1988 |
| WO | 01/22019 | A1 | 3/2001 |
| WO | 2004/102101 | A1 | 11/2004 |

OTHER PUBLICATIONS

Japanese Examiner Shogo Tatai, Rejection Notice for JP Application No. 2010-537348 dispatched Mar. 13, 2012.

Decision on Grant for Russian Patent Application No. 2010128607 dated Dec. 12, 2011 with English translation.

* cited by examiner

SPIRAL HEAT EXCHANGER

This application is a divisional of U.S. application Ser. No. 12/746,971 having a filing date of Aug. 2, 2010, which is a U.S. national stage application based on International Application No. PCT/EP08/64986 having an international filing date of Nov. 5, 2008 and which claims priority to European Application No. 07122869.6 having a filing date of Dec. 11, 2007, the entire content of all three of which is incorporated herein by reference.

AREA OF INVENTION

The present invention refers generally to spiral heat exchangers allowing a heat transfer between two fluids at different temperature for various purposes. Specifically, the invention relates to a spiral heat exchanger being so that the spiral body and the external shell need not to be welded together for the assembly of the spiral heat exchanger.

BACKGROUND OF INVENTION

Conventionally, spiral heat exchangers are manufactured by means of a winding operation. The two sheets are welded together at a respective end, wherein the welded joint will be comprised in a center portion of the sheets. The two sheets are winded around one another by use of a retractable mandrel or the like to form the spiral element of the sheets so as to delimit two separate passages or flow channels. Distance members, having a height corresponding to the width of the flow channels, are attached to the sheets.

After retraction of the mandrel, two inlet/outlet channels are formed in the center of the spiral element. The two channels are separated from each other by the center portion of the sheets. A shell welded onto the outer periphery of the spiral element. The side ends of the spiral element are processed, wherein the spiral flow channels may be laterally closed at the two side ends in various ways. Typically, a cover is attached to each of the ends. One of the covers may include two connection pipes extending into the center and communicating with a respective one of the two flow channels. At the radial outer ends of the spiral flow channels a respective header is welded to the shell or the spiral element form an outlet/inlet member to the respective flow channel. Alternatively, one single sheet is used for the manufacturing of the heat exchanger.

To enable the cleaning of the spiral heat exchanger different solutions has been used in the past. In GB-A-2 140 549 is disclosed a heat exchanger having a central passage body with a central spiral body. Cover plates are flanges onto the both sides of the central passage body. The flow channel of the spiral heat exchanger is thereby easy accessible for cleaning. In another document, U.S. Pat. No. 4,546,826, is disclosed a conventional spiral heat exchanger having a shell comprising three parts, a mid-section and two sections. Flanges of the end sections are attached to corresponding flanges of the mid-section.

In GB-A-1 260 327 is disclosed a heat exchanger having spiral tubular coil members housed in a shell. The shell has an upper section and a lower section, which are joined by flanges and bolts.

One problem with the conventional spiral heat exchangers are that they do not enable the replacing of the spiral body formed by the sheets if it is worn as the spiral body is welded to the cover or shell of the spiral heat exchanger.

DISCLOSURE OF INVENTION

The object of the present invention is to overcome the problems mentioned above with the prior art spiral heat exchangers. More specifically, it is aimed at a spiral heat exchanger which the shell to be flexible arranged in respect of the spiral body and where the spiral body can be a spare part that can be exchanged for a new spiral body without a heavy work, where the parts of the spiral heat exchanger can be manufactured in parallel and where the spiral body will be easy accessible for cleaning.

This object is achieved by a spiral heat exchanger including a spiral body formed by at least one spiral sheet wounded to form the spiral body forming at least a first spiral-shaped flow channel for a first medium and a second spiral-shaped flow channel for a second medium, wherein the spiral body is enclosed by a substantially cylindrical shell being provided with connecting elements communicating with the first flow channel and the second flow channel, where the shell comprises at least two shell parts, and that the spiral body is provided with at least one fixedly attached flange on its outer peripheral surface, whereupon the at least two shell parts are flexibly attached.

According a further aspect of the invention the flange of the spiral body is symmetrically arranged at the centre of the spiral body having an equal distance to the ends of the spiral body from the at least one flange.

According another aspect of the invention the flange of the spiral body is asymmetrically arranged on the peripheral of the spiral body having a different distance to the ends of the spiral body from the at least one flange.

The at least one flange of the spiral body divides the outermost space of the spiral heat exchanger into at least two spaces, the outer most spaces being defined by the outer peripheral of the spiral body and the at least two shell parts at the location of the flange in respect of the ends of the spiral body.

The location of the flange along the peripheral of the spiral body allows control of the velocity of the mediums of the spiral heat exchanger.

According another aspect of the invention each shell is provided two connecting elements communicating with one of the two flow channels, and each shell is provided with one connecting element on its peripheral surface and with one connecting element arranged on one of its end surfaces for communication with one of the two flow channels.

According yet another aspect of the invention the at least two shell parts are each provided with a flange arranged at an open end of the at least two shell parts for fixedly attaching the shell parts to the flange of the spiral body. The flanges of the two shell parts are arranged so that the two shell parts can be independently attached and/or detached in respect of the spiral body.

According a further aspect of the invention the spiral heat exchanger is further provided gaskets flexibly arranged between the end portions of the spiral body and an inner surface of the closed end portions of the shell part. The spiral heat exchanger is also provided with a further set of gaskets arranged between the flanges of the shell parts and the flange of the spiral body.

Another object of the present invention is to provide a spiral heat exchanger that easily can be used for a need of increased capacity or increased thermal length.

This object is achieved by a system of spiral heat exchanger arranged in series or in parallel, where the spiral heat exchanger includes a spiral body formed by at least one spiral sheet wounded to form the spiral body forming at least a first spiral-shaped flow channel for a first medium and a second spiral-shaped flow channel for a second medium, wherein the spiral body is enclosed by a substantially cylindrical shell being provided with connecting elements communicating with the first flow channel and the second flow channel, where the shell comprises at least two shell parts, and that the spiral body is provided with at least one fixedly attached flange on its outer peripheral surface, whereupon the at least two shell parts are flexibly attached.

Further aspects of the invention is apparent from the dependent claims and the description

BRIEF DESCRIPTION OF THE DRAWINGS

Further objects, features and advantages will appear from the following detailed description of several embodiments of the invention with reference to the drawings, in which.

DETAILED DESCRIPTION OF EMBODIMENTS

A spiral heat exchanger includes at least two spiral sheets extending along a respective spiral-shaped path around a common centre axis and forming at least two spiral-shaped flow channels, which are substantially parallel to each other, wherein each flow channel includes a radially outer orifice, which enables communication between the respective flow channel and a respective outlet/inlet conduit and which is located at a radially outer part of the respective flow channel with respect to the centre axis, and a radially inner orifice, which enables communication between the respective flow channel and a respective inlet/outlet chamber, so that each flow channel permits a heat exchange fluid to flow in a substantially tangential direction with respect to the centre axis, wherein the centre axis extends through the inlet/outlet chambers at the radially inner orifice. Distance members, having a height corresponding to the width of the flow channels, are attached to the sheets.

Figure 1:
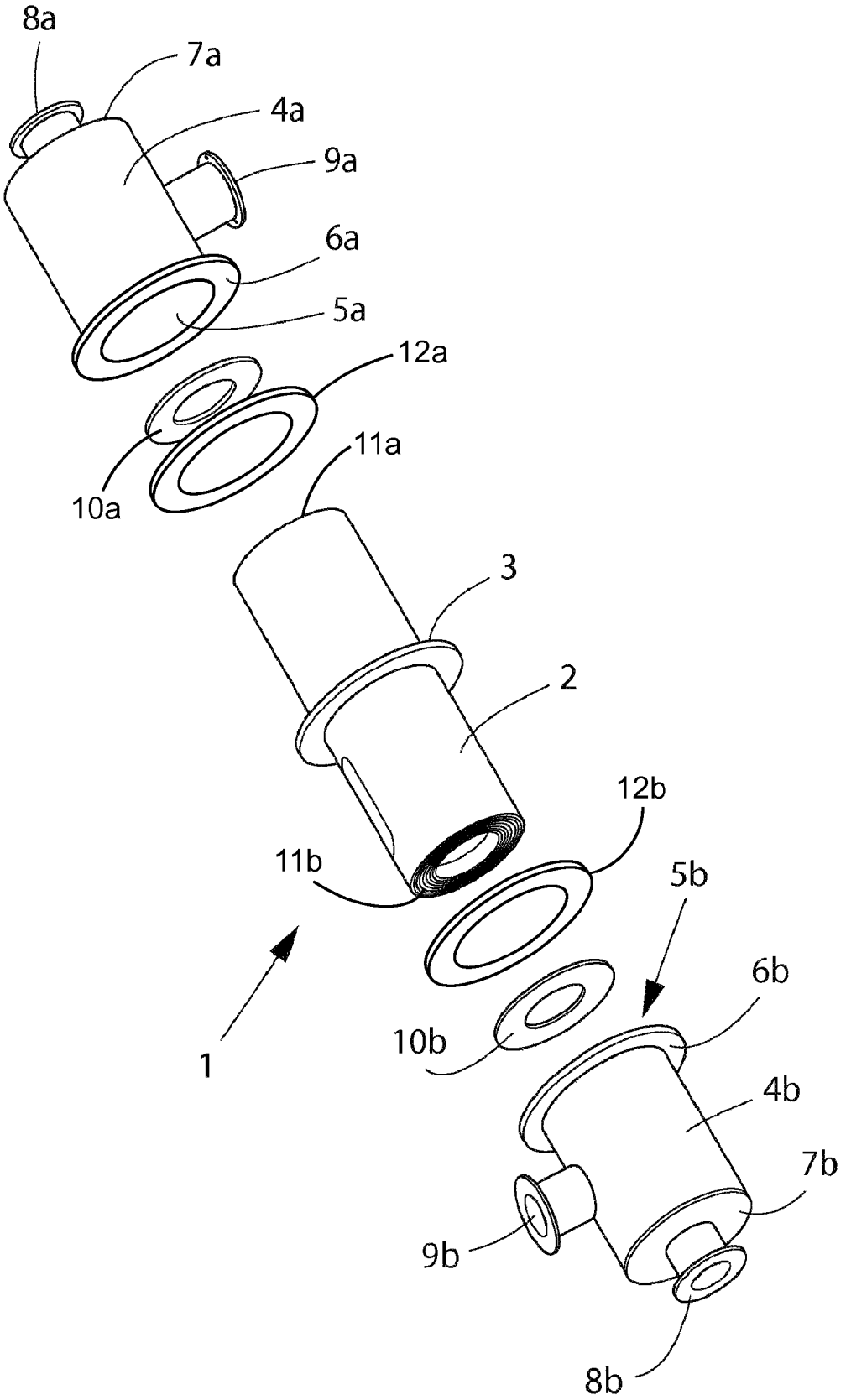
FIG. 1 is an exploded view of a spiral heat exchanger according to the present invention.

In FIG. 1 is shown an exploded view of a spiral heat exchanger 1 according to the present invention. The spiral heat exchanger 1 includes a spiral body 2, formed in a conventional way by winding two sheets of metal around a retractable mandrel. The sheets are provided with distance member (not shown) attached to the sheets or formed in the surface of the sheets. The distance members serve to form the flow channels between the sheets and have a height corresponding to the width of the flow channels. In the drawing the spiral body 2 only has been schematically shown with a number of wounds, but it is obvious that it may include further wounds and that the wounds are formed from the centre of the spiral body 2 all the way out to the peripheral of the spiral body 2. Onto a central or middle portion of an outer peripheral of the spiral body 2 a flange 3 has been attached. The spiral body 2 is enclosed by a shell 4, which comprises two separate shell part 4*a* and 4*b*. Each of the shell parts 4*a* and 4*b* encloses one half of the spiral body 2. The flange 3 is typically attached to the spiral body 2 by welding, by other means are also possible.

The shell part 4*a* is formed as a cylinder having an open end 5*a*, the open end 5*a* being provided with a flange 6*a* corresponding to the flange 3 of the spiral body 2 and enabling the shell part 4*a* to be attached to the flange 3. The other end portion 7*a* of the shell parts 4*a* is closed having a first connection element 8*a* centrally attached to the end portions 7*a* of the shell part 4*a*. To the mantle of the shell part 4*a* is attached a second connection element 9*a*. The shell part 4*b* is substantially identical to the shell part 4*a* having an open end with a flange 6*b*, a closed end portion 7*b* with a first connection element 8*b* and a second connection element 9*b* attached to the mantle of the shell part 4*b*. The connection elements 8*a*-*b* and 9*a*-9*b* are typically welded to the shell parts and are all provided with a flange for connecting the spiral heat exchanger 1 to a piping arrangement of the system of which the spiral heat exchanger 1 is a part of.

The spiral heat exchanger 1 is further provided with gaskets 10*a*, 10*b*, each gasket being arranged between the end portions 11*a*, 11*b* of the spiral body 2 and the inner surface of the closed end portions 7*a*, 7*b* of the shell part 4*a*, 4*b*, respectively, to seal off the flow channels from each other. The gaskets 10*a*, 10*b*, can be formed as a spiral similar to the spiral of the spiral body 2, and then squeezed into each wind of the spiral body 2. Alternatively the gaskets 10*a*, 10*b* are squeezed between the spiral body 2 and the inner surface of the closed end portions 7*a*, 7*b* of the shell part 4*a*, and 4*b*. The gaskets can also be configured in other ways as long as the sealing effect is achieved. Another set of gaskets 12*a*, 12*b* are provided between the flanges 6*a*, 6*b* of the shell parts 4*a*, 4*b* and the flange 3 of the spiral body 2.

The shell parts 4*a*, 4*b* are normally attached to the spiral body 2, i.e. the flanges 6*a*, 6*b* of the shell parts 4*a*, 4*b* are attached to the flange 3 of the spiral body 2, by a common joint, such as bolt connection, clamp connection or the like. It is also possible to have separate joints for the flanges 6*a*, 6*b* of the shells part to attach to the flange 3 of the spiral body 2 so that the shell parts 4*a*, 4*b* can be mounted and/or dismounted from the spiral body 2 separately.

Figure 2:
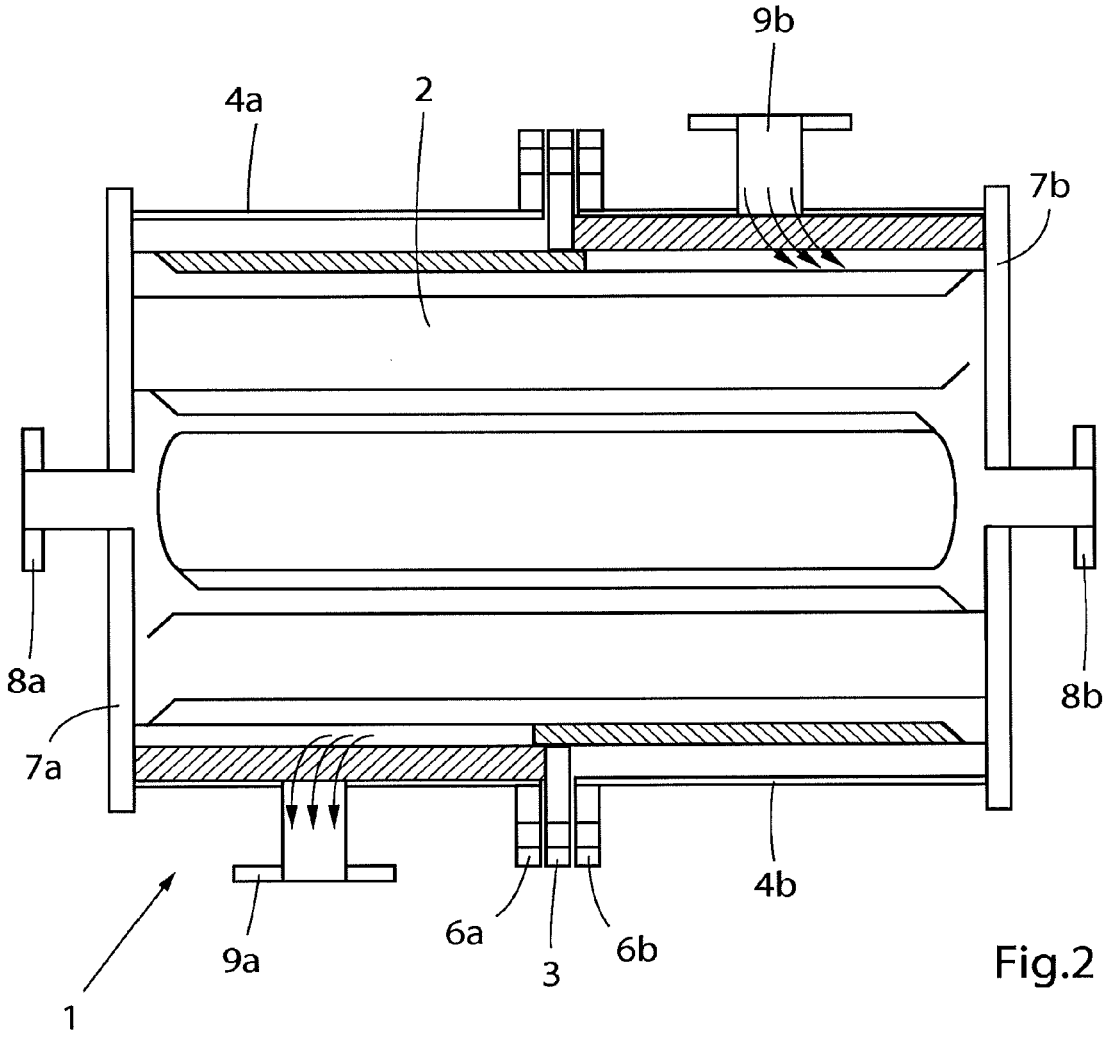
FIG. 2 is a cross sectional view of a spiral heat exchanger according to the present invention.

In FIG. 2 a cross sectional view of the spiral heat exchanger 1 according to the invention is shown.

Although it has not been mentioned it clear for a man skilled in the art that the outer surface of the spiral body is normally provided with studs or distance members) that supports against the inner surface of the shell to resist the pressure of the working fluids of the spiral heat exchanger.

The functionality of the spiral heat exchanger 1 is as follows: A first medium enters the spiral heat exchanger 1 through the first connection element 8*a* formed as an inlet and where first connection element 8*a* is connected to a piping arrangement. The first connection element 8*a* communicates with a first flow channel of the spiral body 2 and the first medium is transported through the first flow channel to the second communication element 9*a* formed as an outlet, where the first medium leaves the spiral heat exchanger 1. The second communication element 9*a* is connected to a piping arrangement for further transportation of the first medium.

A second medium enters spiral heat exchanger 1 through the second connection element 9*b* formed as an inlet, the second connection element 9*b* being connected to a piping arrangement. The second connection element 9*b* communicates with a second flow channel of the spiral body 2 and the second medium is transported through the second flow channel to the first connection element 8*b* formed as an outlet, where the second medium leaves the spiral heat exchanger 1. The first connection element 8*b* is connected to a piping arrangement for further transportation of the second medium.

Inside the spiral body 2 a heat exchange will occur between the first and second medium, so that one medium is heated and the other medium is cooled. Depending on the specific use of the spiral heat exchanger 1 the selection of the two mediums will vary. In the above it has been described as the two mediums circulate in opposite directions through the spiral heat exchanger, but it is apparent that they may also circulate parallel directions.

Figure 3A:
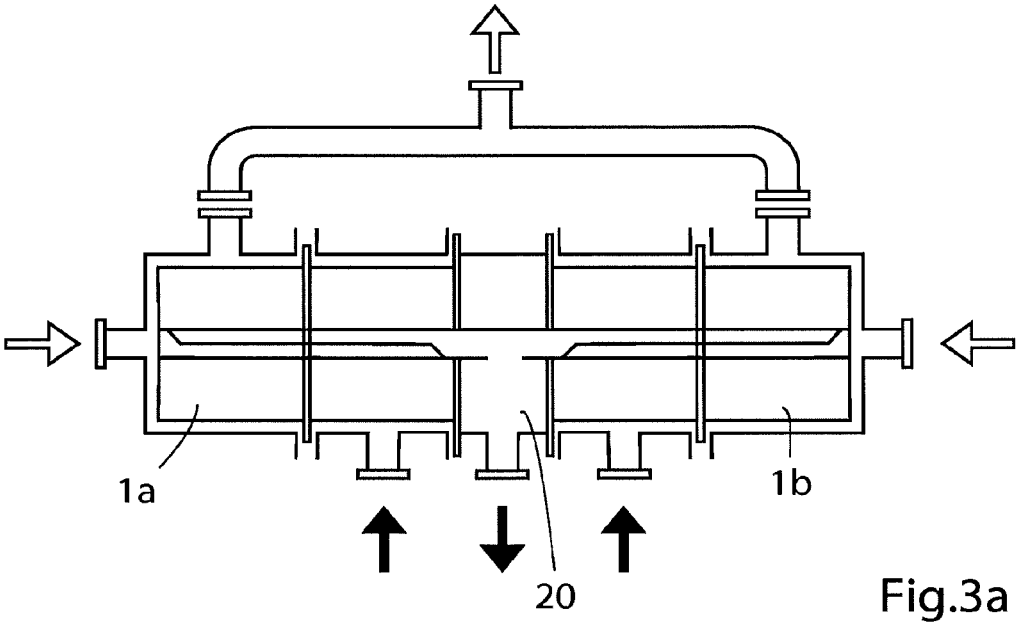
FIGS. 3*a*-3*b* are cross sectional view of spiral heat exchangers according to the present invention being connected in parallel.
Figure 3B:
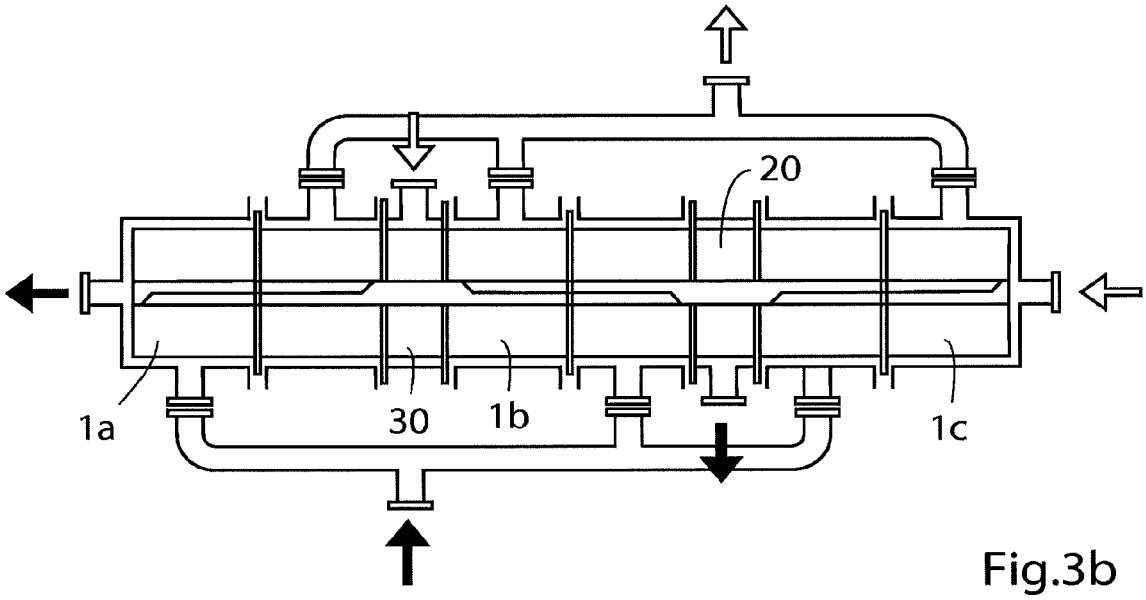

To increase the capacity or of the spiral heat exchanger according to the invention several spiral heat exchanger can be connected in parallel, see FIGS. 3*a* and 3*b*. In FIG. 3*a* two spiral heat exchangers 1*a*, 1*b* have been connected in parallel with an intermediate part 20 arranged between the two spiral heat exchanger 1*a*, 1*b*. The intermediate part 20 serves as an outlet connection for one of the mediums for both spiral heat exchangers 1*a*, 1*b*. In FIG. 3*b* three spiral heat exchangers 1*a*, 1*b*, 1*c* have been connected in parallel with a first intermediate part 20 arranged between the two spiral heat exchangers 1*b*, 1*c* and a second intermediate part 30 arranged between the two spiral heat exchangers 1*a*, 1*b*. The first intermediate part 20 serves as an outlet connection for a first of the two mediums for the two spiral heat exchangers 1*b*, 1*c*, and the second intermediate part 30 serves as an inlet connection for the second of the two mediums for the two spiral heat exchangers 1*a*, 1*b*.

Figure 4A:
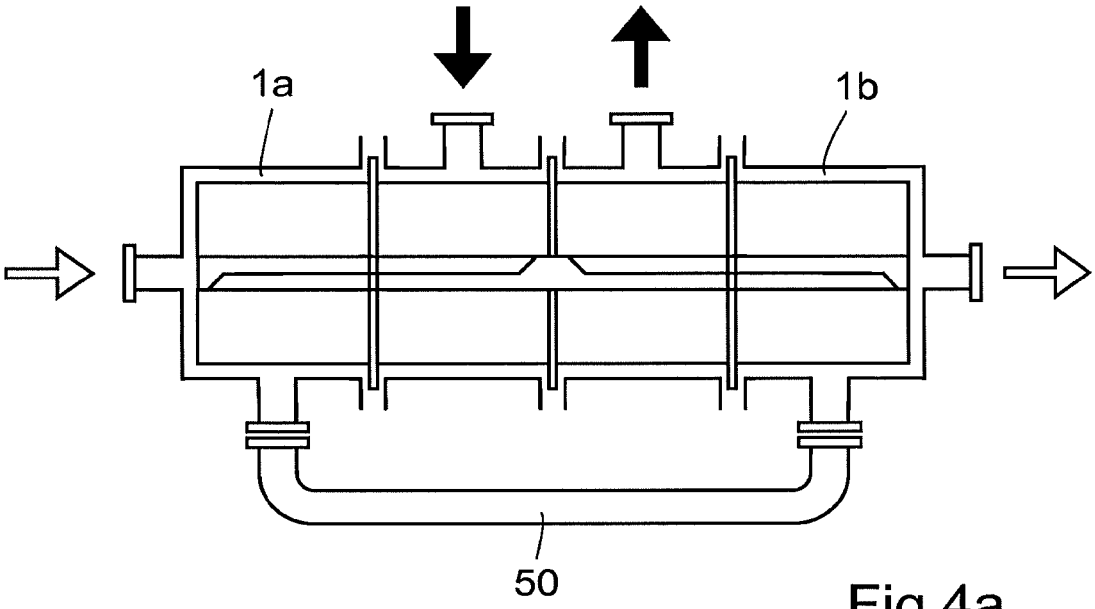
FIGS. 4*a*-4*b* are cross sectional view of spiral heat exchangers according to the present invention being connected in series.
Figure 4B:
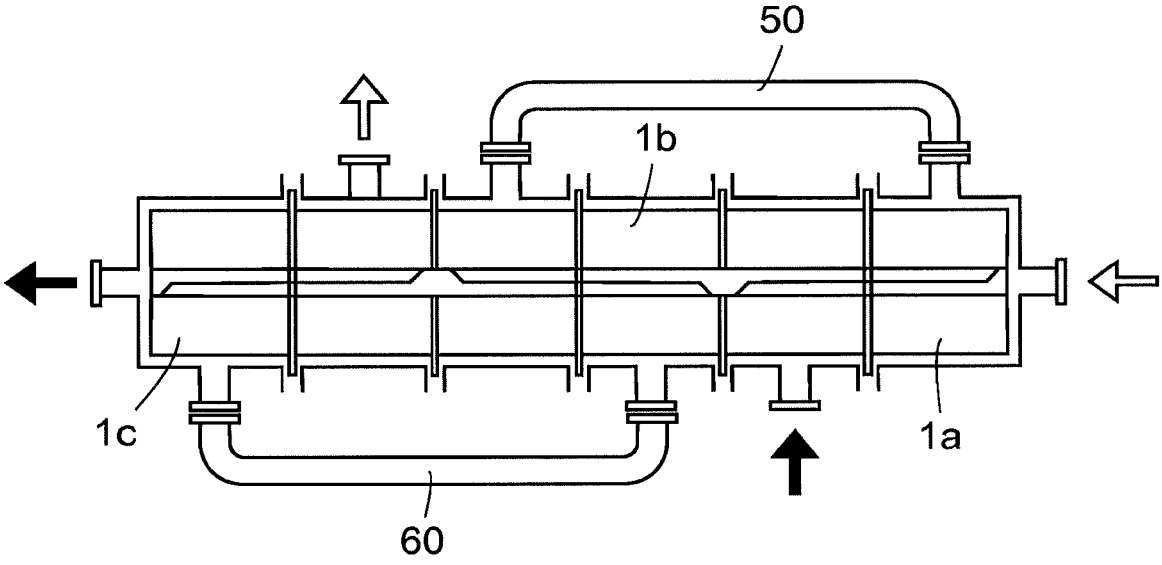

To increase the thermal length or of the spiral heat exchanger according to the invention several spiral heat exchanger can be connected in series, see FIGS. 4*a* and 4*b*. Increased thermal length can be desired for certain applications of the spiral heat exchanger, where the heat transfer between the mediums needs to be longer in time. In FIG. 4*a* two spiral heat exchangers 1*a*, 1*b* have been connected in series. The spiral heat exchangers 1*a*, 1*b* are arranged so that for a first medium the outlet connection of a first spiral heat exchanger 1*a* is directly connected to the inlet connection of a second spiral heat exchanger 1*b*, whereas for the second medium the outlet connection of the first spiral heat exchanger is connected via a pipe 50 to the inlet connection of the second spiral heat exchanger 1*b* for the second medium.

In FIG. 4*b* three spiral heat exchangers 1*a*, 1*b*, 1*c* have been connected in series. Similar to the case when two spiral heat exchangers are connected in series the spiral heat exchangers 1*a*, 1*b* are arranged so that for a first medium the outlet connection of a first spiral heat exchanger 1*a* is directly connected to the inlet connection of a second spiral heat exchanger 1*b*, whereas for the second medium the outlet connection of the first spiral heat exchanger 1*a* is connected via a pipe 50 to the inlet connection of the second spiral heat exchanger 1*b* for the second medium. Further the third spiral heat exchanger 1*c* is arranged so that the outlet connection of the second spiral heat exchanger 1*b* for the first medium is connected via a pipe 60 to the inlet connection of the third spiral heat exchanger 1*c*. The outlet connection of the second spiral heat exchanger 1*b* for the second medium is directly connected to the inlet connection of third spiral heat exchanger 1*c*.

Even though it has only been shown having two or three spiral heat exchanger 1 connected in parallel or in series it is apparent that further spiral heat exchangers can be connected if the specific application of the spiral heat exchangers requires that, and that the invention is not limited to the shown embodiments.

Figure 5A:
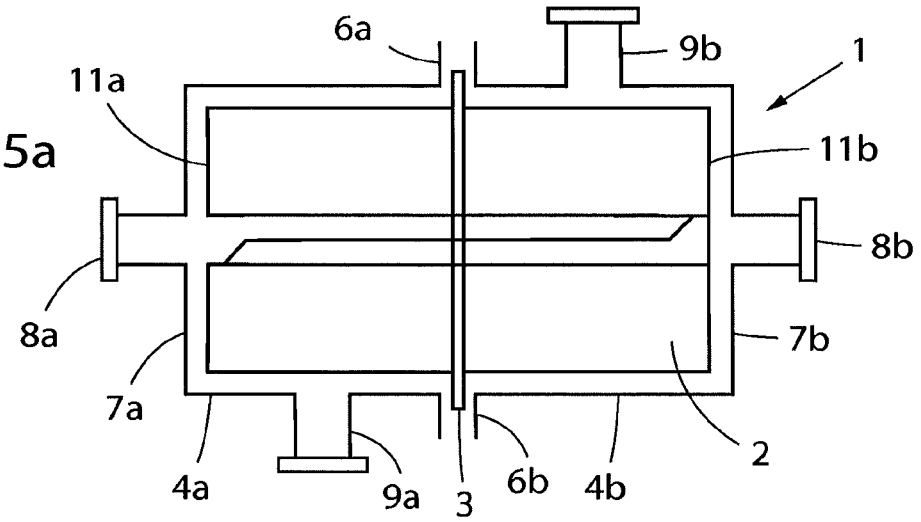
FIGS. 5*a*-5*c* are cross sectional views of the spiral heat exchanger according to the present invention with alternative embodiments.
Figure 5B:
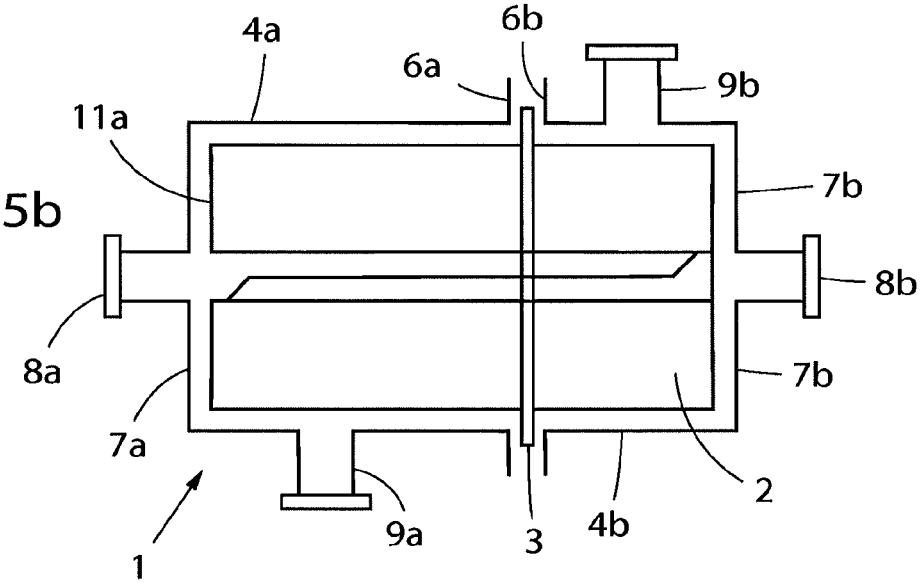
Figure 5C:
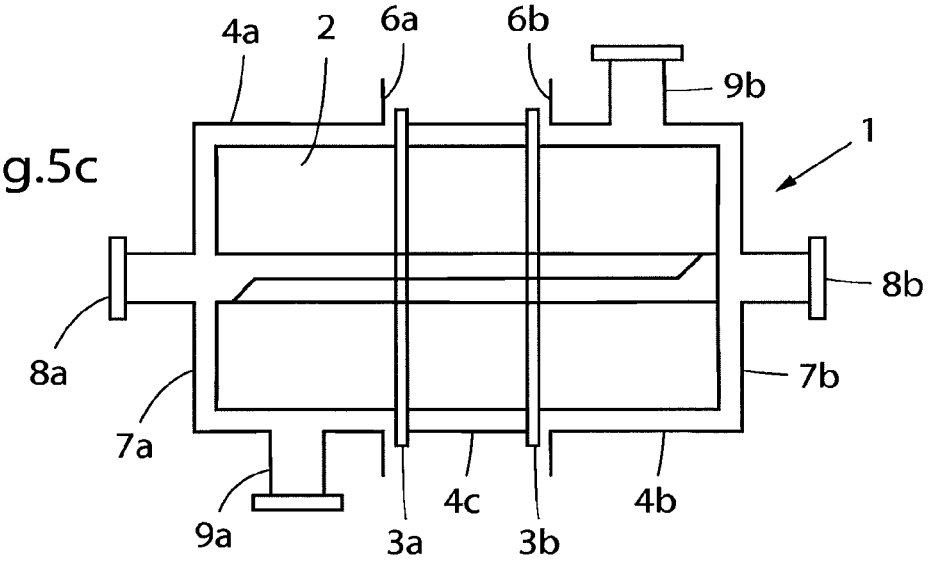

In FIG. 5*a* the normal set-up of a spiral heat exchanger 1 according to the present invention is disclosed. In FIG. 5*b* an another embodiment of the present invention is disclosed, where the flange 3 is asymmetrically attached or mounted to the spiral body 2 of the spiral heat exchanger 1 in that the distance from the flange 3 to the two ends of the spiral body 2 is not equal. In FIG. 5*c* an alternative configuration of this embodiment is disclosed, where an intermediate shell 4*c* is provide on the spiral heat exchanger 1 between two flanges 3*a*, 3*b* of the spiral body 2. The shell parts 4*a*, 4*b* are attached to the spiral body 2 similar to that described above. Although it shown in FIG. 5*c* as if the shell parts 4*a*, 4*b* are equal in length it obvious that they can be configured as the shell parts 4*a*, 4*b* of FIG. 5*b* so that the distance from the flange 3*a*, 3*b* to the two ends of the spiral body 2 is not equal.

By having the flange 3 dislocated from the centre of the spiral body 2 as shown in FIG. 5*b* or by having two flanges 3*a*, 3*b* with an intermediate shell 4*c* as shown in FIG. 5*c*, the volume of the "last turn", i.e. space between the shell parts 4*a*, 4*b* and the peripheral of the spiral body 2 can be altered, thus the velocity of the medium in the "last turn" can be controlled. This is advantageous when having a medium with one critical velocity or when having an intermediate shell 4*c* for two fluids with critical velocity (see FIG. 5*c*).

As the flange divides the outer surface or peripheral of the spiral body into two separate chambers the distribution of the medium will be improved as the medium will only need to distribute on the half of the length of the spiral body.

Since the shell of the spiral heat exchanger according to the invention is provided as two separate and independent shell parts it is possible to using different materials for the two shell parts.

An advantage by having the connection elements only attached to the shell and not being in contact with the spiral body, which otherwise is the normal construction of spiral heat exchangers, is that the thermal fatigue or stress is significantly reduced.

The spiral heat exchanger according to the present invention benefits among many things in that is easier to clean, the spiral body can be exchanged, the easy exchange of the spiral body enables almost continues production and the manufacturing of the spiral heat exchanger is faster and cheaper since the shell and spiral body can be manufactured in parallel.

In the above description the term connecting element has been used as an element connected to spiral heat exchanger and more specifically to the flow channels of the spiral heat exchanger, but it should be understood that the connecting element is a connection pipe or similar that typically are welded onto the spiral heat exchanger and may include means for connecting further piping arrangements to the connecting element.

The invention is not limited to the embodiments described above and shown on the drawings, but can be supplemented and modified in any manner within the scope of the invention as defined by the enclosed claims.

What is claimed is:

1. A system of spiral heat exchangers arranged in series or in parallel, wherein the spiral heat exchangers comprise a spiral body in which at least one spiral sheet is configured to define at least a first spiral-shaped flow channel for a first medium and a second spiral-shaped flow channel for a second medium, wherein the spiral body possesses opposite ends and an outer peripheral surface, wherein the spiral body is enclosed by a shell provided with connecting elements communicating with the first flow channel and the second flow channel, the shell comprising at least two shell parts, and the spiral body being provided with at least one flange possessing an inner periphery that is fixedly attached onto the outer peripheral surface of the spiral body at an intermediate location between the opposite ends of the spiral body so that portions of the spiral body are positioned on opposite sides of the flange, the at least two shell parts being releasably coupled to each other, and the spiral heat exchangers being coaxially arranged and connected to one another.

2. A system of spiral heat exchangers according to claim 1, wherein the flange of the spiral body is symmetrically arranged at a center of the spiral body having an equal distance to ends of the spiral body from the at least one flange.

3. A system of spiral heat exchangers according to claim 1, wherein the flange of the spiral body is asymmetrically arranged on the outer peripheral surface of the spiral body having different distances to ends of the spiral body from the at least one flange.

4. A system of spiral heat exchangers according to claim 2, wherein each spiral heat exchanger includes an outermost space, the at least one flange of the spiral body divides the outermost space of the spiral heat exchanger into at least two spaces, with outermost spaces defined by the outer peripheral surface of the spiral body and the at least two shell parts.

5. A system of spiral heat exchangers according to claim 1, wherein the each shell of each spiral heat exchanger includes two connecting elements communicating with one of the two flow channels.

6. A system of spiral heat exchangers according to claim 5, wherein the shell of each spiral heat exchanger possesses an outer peripheral surface and oppositely positioned end surfaces, and wherein the shell of each spiral heat exchanger is provided with one connecting element on its outer peripheral surface and with one connecting element arranged on one of its end surfaces for communication with one of the two flow channels.

7. A system of spiral heat exchangers according to claim 1, wherein the at least two shell parts are each provided with a flange arranged at an open end of the at least two shell parts for fixedly attaching the shell parts to the flange of the spiral body.

8. A system of spiral heat exchangers according to claim 7, wherein the flanges of the two shell parts are arranged so that the two shell parts are independently attachable and/or detachable relative to the spiral body.

9. A system of spiral heat exchangers according to claim 1, wherein the spiral heat exchanger further comprises gaskets arranged between end portions of the spiral body and an inner surface of closed end portions of the shell part.

10. A system of spiral heat exchangers according to claim 9, wherein each of the shell parts includes a flange, and wherein the gaskets are first gaskets, and wherein the spiral heat exchanger further comprises a further set of gaskets arranged between the flanges of the shell parts and the flange of the spiral body.

11. A spiral heat exchanger system comprising:

a spiral body formed by at least one wound spiral sheet forming at least a first spiral-shaped flow channel for a first medium and a second spiral-shaped flow channel for a second medium;

the spiral body being enclosed by a shell, the shell comprising at least two shell parts, each of the shell parts having oppositely disposed ends, with one end of a first one of the shell parts facing the one end of a second one of the shell parts;

the spiral body being provided with at least one flange having an inner periphery that is fixedly attached onto an outer peripheral surface of the spiral body at an intermediate location that is positioned between the one end of the one shell and the one end of the other shell, the first and second shell parts being coupled together;

a plurality of connections spaced apart on the shell, the plurality of connections including first medium connections each communicating with the first spiral-shaped flow channel to introduce the first medium into the spiral heat exchanger system and permit the first medium to exit the first spiral-shaped flow channel, the plurality of connections also including a plurality of second medium connections each communicating with the second spiral-shaped flow channel to introduce the second medium into the spiral heat exchanger system and permit the second medium to exit the second spiral-shaped flow channel; and at least one pipe extending outside the shell and connecting two of the connections to fluidly communicate said two connections.

12. The spiral heat exchanger system according to claim 11, wherein the first medium connections comprise an inlet at each axial end of the shell configured to introduce the first medium into the spiral heat exchanger system, and the second medium connections comprise two inlets at an intermediate portion of the shell located between the two axial ends configured to introduce the second medium into the spiral heat exchanger system.

13. The spiral heat exchanger system according to claim 12, wherein the first medium connections further comprise an outlet positioned at an intermediate portion of the at least one pipe configured to convey the first fluid medium out of the spiral heat exchanger system.

14. The spiral heat exchanger system according to claim 11, wherein the first medium connections comprise an inlet at one axial end of the shell configured to introduce the first medium into the spiral heat exchanger system, and wherein the second medium connections comprise an outlet at an opposite axial end of the shell configured to convey the first second fluid medium out of the spiral heat exchanger system.

15. The spiral heat exchanger system according to claim 14, wherein the first medium connections further comprise an outlet positioned at an intermediate portion of the at least one pipe to convey the first fluid medium out of the spiral heat exchanger system.

16. The spiral heat exchanger system according to claim 11, wherein the at least one pipe extending outside the shell and connecting two of the connections includes a first pipe extending outside the shell and connecting a first two of the connections to fluidly communicate said first two connections, and a second pipe extending outside the shell and connecting a second two of the connections to fluidly communicate said second two connections.

17. The spiral heat exchanger system according to claim 16, further comprising an outlet positioned at an intermediate portion of the first pipe configured to convey the first fluid medium out of the spiral heat exchanger system, and an inlet positioned at an intermediate portion of the second pipe configured to introduce the second medium into the spiral heat exchanger system.

18. The spiral heat exchanger system according to claim 11, wherein the first medium connections comprise an inlet at one axial end of the shell configured to introduce the first medium into the spiral heat exchanger system and an outlet at an opposite axial end of the shell configured to convey the first fluid medium out of the spiral heat exchanger system, and wherein the second medium connections comprise an inlet at an intermediate portion of the shell configured to introduce the second medium into the spiral heat exchanger system and an outlet at an intermediate portion of the shell configured to convey the second fluid medium out of the spiral heat exchanger system.

19. The spiral heat exchanger system according to claim 11, wherein the first medium connections comprise an inlet at one axial end of the shell configured to introduce the first medium into the spiral heat exchanger system and an outlet at an intermediate portion of the shell configured to convey the first fluid medium out of the spiral heat exchanger system, and the second medium connections comprise an outlet at an opposite axial end of the shell configured to convey the second fluid medium out of the spiral heat exchanger system and an inlet at an intermediate portion of the shell configured to introduce the second medium into the spiral heat exchanger system.

20. The spiral heat exchanger system according to claim 1, further comprising at least one pipe extending outside the shell and connecting two of the connections to fluidly communicate the two connections.

* * * * *